United States Patent [19]

Sadigh-Behzadi et al.

[11] Patent Number: 4,781,604

[45] Date of Patent: Nov. 1, 1988

[54] ELECTRICAL CONNECTOR INCLUDING A METALLIC HOUSING AND INTEGRAL GROUND CONTACT

[75] Inventors: Amir-Akbar Sadigh-Behzadi; Gary C. Bethurum, both of Los Angeles, Calif.

[73] Assignee: Thomas & Betts Corporation, Bridgewater, N.J.

[21] Appl. No.: 28,923

[22] Filed: Mar. 23, 1987

[51] Int. Cl.[4] ..... H01R 13/53; H01R 13/652

[52] U.S. Cl. ..... 439/101; 439/608

[58] Field of Search ..... 439/65, 78, 79, 80, 439/92–108, 607–610

[56] References Cited

U.S. PATENT DOCUMENTS

| | | | |
|---|---|---|---|
| 1,672,067 | 6/1928 | Labre | 439/106 |
| 2,804,601 | 8/1957 | Harthman et al. | 439/608 |
| 4,451,107 | 5/1984 | Dola et al. | 439/608 |
| 4,512,618 | 4/1985 | Kumar | 439/95 |
| 4,519,665 | 5/1985 | Althouse et al. | 439/608 |
| 4,521,062 | 6/1985 | Kurbikoff et al. | 439/92 |
| 4,568,133 | 2/1986 | Amano et al. | 439/108 |
| 4,571,014 | 2/1986 | Robin et al. | 439/108 |
| 4,624,515 | 11/1986 | Brush, Jr. et al. | 439/95 |

FOREIGN PATENT DOCUMENTS 2350793 5/1975 Fed. Rep. of Germany ..... 439/76

*Primary Examiner*—Neil Abrams

*Attorney, Agent, or Firm*—Robert M. Rodrick; Salvatore J. Abbruzzese

[57] ABSTRACT

An electrical connection arrangement includes a printed circuit board comprising a substrate and a given number of electrically conductive traces disposed on a surface thereof. Each trace has an opening therethrough for receiving a contact and the openings are in a predetermined array. An electrically insulative body supports all but one of such contacts with individual opposite ends thereof extending outwardly of the body. An electrically conductive metallic housing integrally defines the other of such contacts with opposite ends extending outwardly thereof and has a passage extending therethrough in which the electrically insulative body is seated. All of the contacts are individually resident in distinct ones of such trace openings and are electrically connected to said traces and their opposite ends may terminate to associated connectors for terminating flat cable to the printed circuit board. The housing has an integral flange which is in electrical contact with its integral contact, whereby the circuitry may be connected to structure parent to the housing without need for a conductive strap.

7 Claims, 4 Drawing Sheets

ELECTRICAL CONNECTOR INCLUDING A METALLIC HOUSING AND INTEGRAL GROUND CONTACT

FIELD OF THE INVENTION

This invention relates generally to electrical connectors and pertains more particularly to connectors for automotive and other applications involving need for interconnecting electrical circuitry and parent vehicle structure.

BACKGROUND OF THE INVENTION

In a number of electrical connection instances, electrical circuit ground or electrical circuit completion is achieved through parent structure. For example, in simplifying automobile electrical wiring systems, it has long been customary to connect one battery terminal to the automobile metallic frame or chassis. Individual functioning circuits, such as for energizing the starting motor, are effected by wiring from the battery terminal which floats with respect to chassis to the user device and by electrically connecting the user device as a load between such wiring and the chassis.

This latter connection is often effected at present by direct mechanical connection of the user device housing to the chassis, e.g., as in the case of tail lamps releasably retained in housing openings by conductive mounting springs electrically continuous with the return sides of the lamp filaments. In other instances, where the user device has an electrical return terminal insulated with respect to the user device housing, such as the starting motor, radio and other units, it is necessary to employ an adjunct member, typically an electrically conductive strap, connected between such terminal and the automobile chassis.

In the case of present day automobiles, various diverse conneccions exist for radios, inclusive of antenna input connection, power connection, equalizers and the like where printed circuits are employed for coordinating the various inputs. In one prior art connector arrangement for this purpose, a plastic and thus electrically insulative housing has a front face into which extend four separate compartments for respective receipt of the diverse input connectors. In each compartment an array of male contacts is supported by the housing in disposition corresponding to the array of female contacts in the connector to be seated in the compartment. The male contacts have first ends facing the front face and second opposite ends extending outwardly of the housing sufficiently to enter openings in a printed circuit board and be soldered in place therein. A ground or return power connection is effected among the midst of the male contacts. As heretofore known, this latter connection is required to be made by such electrically conductive strap connection from the printed cicuit board to the automobile chassis.

SUMMARY OF THE INVENTION

It is a primary object of the present invention to provide improved electrical connectors for implementing the types of connection above discussed.

A more specific object of the invention is the provision of electrical connectors for automotive use, wherein the customary conductive strap adjunct is not required for effecting return electrical connection to the automobile chassis.

In the effective attainment of the above and other objects, the invention provides an improved such male electrical connectors for terminating an associated female electrical connectors to a printed circuit board. Such male connector, in general application form, comprises an assembly of a plurality of male contacts, a housing inclusive of an electrically conductive part defining at least a preselected one of such male contacts and an electrically insulative insert supported by the housing and itself supporting the others of the male contacts, both in mutually electrically isolated relation and in electrically isolated relation with respect to such preselected male contact.

In preferred arrangement, the housing is comprised throughout of electrically conductive material and has a passage therethrough retentively supporting the insert. The insert supports its contacts in rectilinear array and the housing itself provides such preselected contact in alignment with such passage and in spacing relative thereto such that uniform rectilinear spacing exists as among all male contacts in the assembly. The housing includes a member in electrically continuous relation with the preselected male contact and adapted for electrically connecting the hosuing with parent structure separate therefrom.

In application to the particular automotive situation discussed above for radio connections, the housing has a front face into which plural compartments extend for receipt of the respective diverse function female connectors. Passages are defined through the housing each for supporting a respective one of the inserts associated with each such female connector. Adjacent one of the inserts, the housing defines such preselected male contact with one end thereof facing the open end of the compartment. The opposite second end of such preselected male contact extends outboard of the housing to enter an associated printed circuit board along with all other male contacts.

Such radio application housing includes a member, integral therewith and thus electrically connected to the preselected male contact, and this member extends outboard of the housing proper to be connectible to the automobile chassis. When soldered into the ground or return pad of the printed circuit board, the preselected male contact completes the associated circuits both in the board and in the connectors inserted into the housing, without need for any conductive strap as in the heretofore known automobile connection arrangment.

The foregoing and other features and objects of the invention will be further understood from the following detailed description of a preferred embodiments of the invention for general usage and further in such radio connection use and from the drawings wherein like reference numerals are employed to identify like parts and components throughout.

DETAILED DESCRIPTION OF THE PREFERRED EMBODIMENTS

Figure 1:
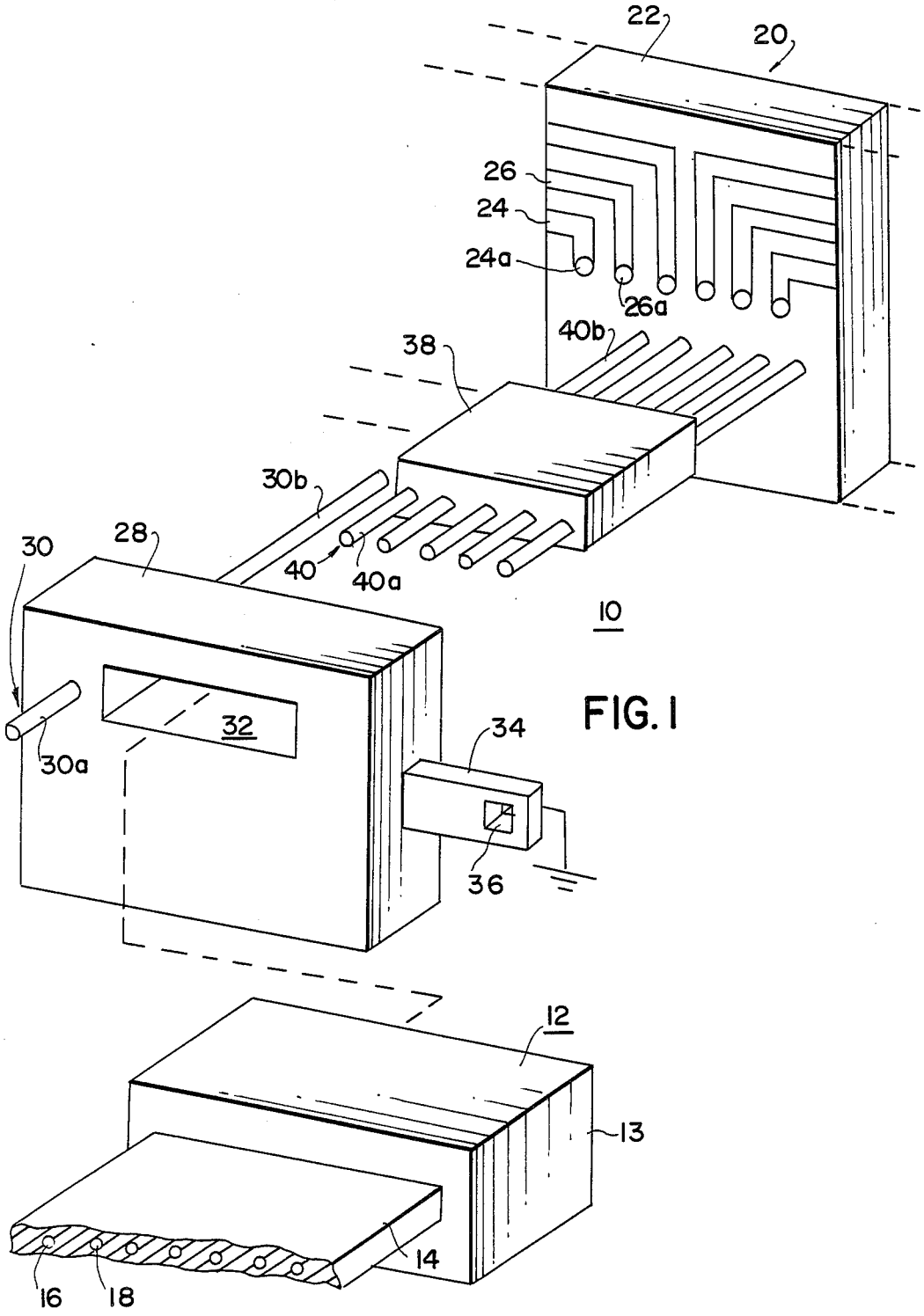
FIG. 1 is an exploded perspective view of components of an electrical connection arrangement in accordance with the invention for general use.
Figure 3:
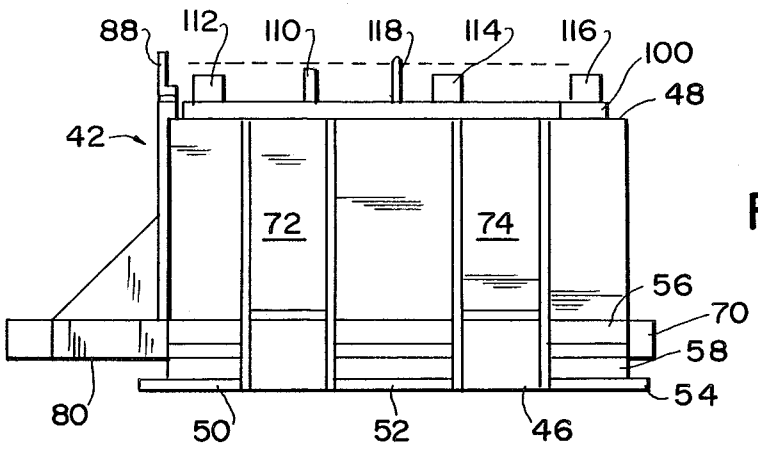
FIG. 3 is a plan view of the FIG. 2 connection arrangement.

Referring to FIG. 1, electrical connection arrangement 10 includes a female connector 12 comprising an electrically insulative housing 13 adapted for receipt of electrical cables, such as a flat multiconductor cable 14 having conductors, such as at 16 and 18, in an electrically insulative encasement. Interiorly of housing 13, connector 12 terminates the individual conductors to female contacts, as by insulation displacement connection (IDC) or other termination technique well known in the art.

A portion of a printed circuit board (PCB) is indicated at 20, and cable 14 is to be interconnected therewith. PCB 20 is comprised of electrically insulative substrate 22 having conductive traces, such as at 24 and 26, disposed on at least one surface thereof. In the example shown in FIG. 1, six individual PCB traces are depicted, each terminating in a pad having an opening for receiving a conductive pin. Openings 24*a* and 26*a* are indicated for traces 24 and 26.

An electrically conductive housing 28 has a pin-shaped male contact 30 integrally formed therewith, with portion 30*a* extending forwardly thereof and portion 30*b* extending rearwardly thereof. Passage 32 is formed in housing 28 in horizontal centerline alignment with the horizontal centerline of contact 30, for purposes below discussed. A side extension 34 is also integral with housing 28 and includes opening 36 extending therethrough to receive a mounting bolt (not shown) for securement to parent structure, thus to provide connection thereto, as is indicated by the electrical ground symbol.

Insert 38 is comprised of electrically insulative material and has exterior configuration corresponding to the boundary of passage 32 to be insertable therein and frictionally retained and has pin-shaped contacts supported therein, one indicated at 40 and having forwardly extending portion 40*a* and rearwardly extending portion 40*b*. When insert 38 is resident in passage 32, the front face thereof is aligned with that of housing 28 and contact portions 30*a* and 40*a* will comprise a set of substantially identical male contacts extending a distance equally from such front faces and mutually equally spaced horizontally. The housing and insert thus define a rectilinearly aligned plurality of contacts, at least one of which is integral with the electrically conductive housing and the other contacts of such plurality are supported in the electrically insulative insert to such housing.

Insert 38 has depth greater than the depth of passage 32 whereby it functions also to provide depthwise spacing upon assembly as between conductive housing 28 and the conductive traces on PCB 20. The rearwardly extending portion 30*b* of contact 30 is selected to be of length longer than the rearward extent of portions 40*b*, such that all of such rearwardly extending contact portions of the contact plurality seat with like depth in PCB 20 upon assembly of the components of FIG. 1.

Upon assembling such components of the FIG. 1 connection arrangement, conductor 16 of cable 14 will be connected with contact portion 30*a* through the female contact of connector 12 terminating conductor 16. Through conductive housing 28 and member 34, conductor 16 will also be electrically connected to grounded parent structure. Further, conductor 18 of cable 14 will be electrically connected to male contact 40. The ultimate connection will be seen to involve conductor 16 and PCB trade 24, thus connecting trace 24 to grounded parent structure without the prior art strap connection, and conductor 18 and PCB trace 26.

Referring to FIGS. 2 through 5 and FIG. 8 an electrical connection arrangement of the FIG. 1 type is shown for the above discussed automobile radio application. Housing and insert assembly 42 is depicted without the associated cable terminating connectors and the PCB is omitted.

Figure 4:
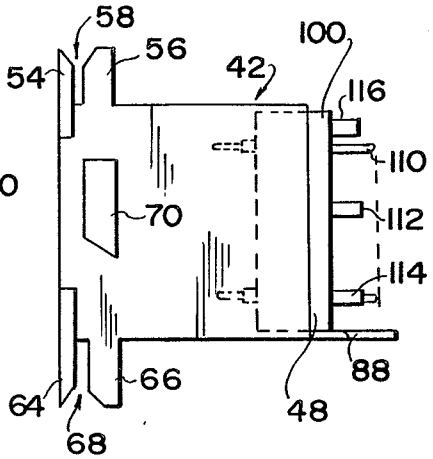
FIG. 4 is a right side elevational view of the FIG. 2 connection arrangement.
Figure 2:
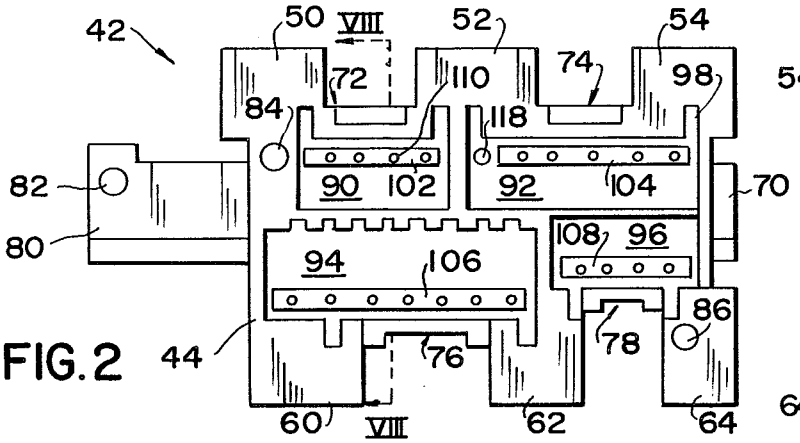
FIG. 2 is a front elevational view of a connection arrangement in accordance with the invention specific to the above discussed automobile radio application.
Figure 5:
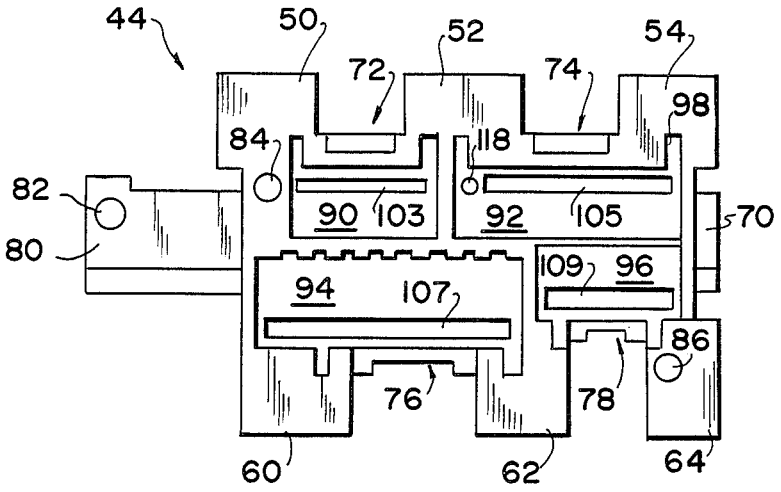
FIG. 5 is a front elevational view of the housing of the FIG. 2 connection arrangement.

Housing 44, constituted throughout by an electrically conductive material such as a metal, preferably zinc, has front face 46 and rear face 48. Mounting members 50, 52 and 54 are provided at the upper boundary of housing 44. As shown in FIG. 4, member 56 is spaced from member 54 to define slot 58 for receipt of parent panel structure, as is also the case for members 50 and 52. At its bottom, housing 44 includes mounting members 60, 62, 64, member 64 having member 66 spaced rearwardly thereof to define mounting sloz 68 for receipt of parent panel structure, as is the case also for members 60 and 62. Parent panel retention is abetted by flange 70, also integral with housing 44. Mounting channels are provided at the upper border of housing 44, as at 72 and 74, and at the lower border, as at 76 and 78.

Extended left flange 80 is also integral with housing 44 and includes mounting opening 82 for securement of the housing to the automobile chassis. Keying openings are shown at 84 and 86, cooperative with panel keys, not shown. At its rearwardmost extent, housing 44 has PCB key 88. It is also contemplated that intermediate the mounting flange 80 and the automobile chassis, a heat sink (not shown) may be interposed. The heat sink would serve to dissipate heat which accompanies connections of components of this type. A further feature of the present invention is that by forming the connector housing 44 itself of a metal, it would serve as its own heat sink.

Opening into front face 46 of housing 44 are four compartments 90, 92, 94, and 96 for the receipt of corresponding connectors terminating cables associated with radio speakers, equalizers, power from battery, etc. Such associated connectors have external polarizing keys for insuring proper insertion into the housing compartments, and the housing defines complemental keying, as indicated, for example at 98.

Insert 100 is comprised throughout of electrically insulative material and is insertable into the rear face 48 of housing 44 to dispose its projections 102, 104, 106, and 108 respectively in passages (103, 105, 107 and 109—FIG. 5) formed in housing 44 and extending from such rear face into communication with compartments 90, 92, 94 and 96.

Figure 6:
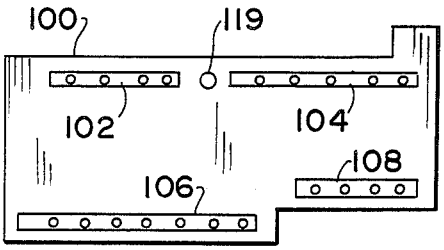
FIG. 6 is a front elevational view of the insert of the FIG. 2 connection arrangement.
Figure 7:
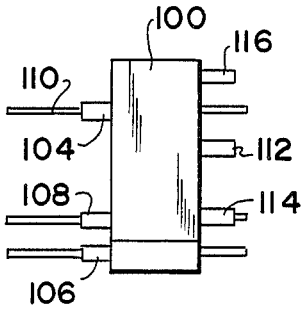
FIG. 7 is a right side elevational view of the FIG. 6 insert.
Figure 8:
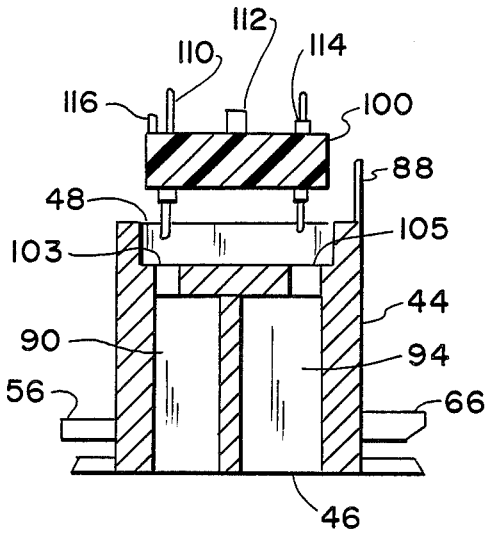
FIG. 8 is an exploded sectional showing of the connection arrangement of FIG. 2 taken through the lines VIII—VIII.

Male contacts 110 are supported by and extend forwardly and rearwardly of insert 100, being grouped as rectilinear arrays of four in projections 102, 104, 106 and 108. Insert 100 also defines at its rearward surface spacer projections 112, 114 and 116 for spacing housing 44 from possible shorting engagement with a PCB, not shown in FIGS. 2–5. Full details of insert 100 are seen in FIGS. 6 and 7, where it is shown separately from housing 44. Of note is the opening 119 therethrough which permits passage of contact 118 on to the PCB.

In compartment 92, adjacent passage 105 (FIG. 5), and in horizontal centerline registry therewith, housing 44 has contact 118 integral therewith and thus in electrical continuity with mounting flange 80. Such contact 118 extends equally forwardly with contacts 110 of projection 104, to form an array therewith of mutually equal contact spacing. Further, such contact 118 has rearward extent to terminate rearwardly equally or beyond contacts 110. Contact 118 is formed to be of like construction to that of contacts 110. Thus, upon insertion of connector 12 (FIG. 1) into compartment 92, connection will be made to contact 118 in a manner similar to the connection with contacts 110. While contact 118 is shown as an end contact in compartment 92, it can be appreciated that contact 118 may be formed anywhere in the contact array as may be dictated by the electrical design.

As will be evident from the foregoing, the invention provides, in one aspect, a first electrical connector for terminating an associated second electrical connector to a printed circuit board, the second connector having a plurality of contacts disposed in a predetermined array. The first connector has a plurality of contacts substantially identical to one another, disposed in such preselected array and complemental with such second connector contacts. A housing is inclusive of an electrically conductive part defining at least a preselected one of such first connector contacts and an electrically insulative insert is supported by the housing and in turn supports the others of the first connector contacts.

Conveniently, the housing is comprised throughout of electrically conductive material and defines a passage therethrough retentively supporting the insert. The predetermined array is a rectilinear array and the insert supports such other first connector contacts in rectilinear array and the housing supports such preselected contact in alignment with such other first connector contacts. The housing includes a member in electrically continuous relation with said preselected contact and adapted for electrically connecting said housing with parent structure separate therefrom.

In another aspect, the invention provides an electrical connector having a plurality of contacts substantially identical to one another, a housing inclusive of an electrically conductive part defining at least a preselected one of the contacts and an electrically insulative insert supported by the housing and supporting the others of the contacts.

In an overall combination aspect, the invention provides a printed circuit board comprising a substrate and a given number of electrically conductive traces disposed on a surface thereof, each such trace having an opening therethrough for receiving a contact, the openings being in a predetermined array. An electrically insulative body supports a first number of such contacts with individual opposite ends thereof extending outwardly of the body. An electrically conductive housing integrally defines further such contacts in second number, which is one in the example given. The sum of the first and second numbers is equal to the given number. Individual opposite ends of such further contacts extend outwardly of the body. The housing further has a passage extending therethrough and the electrically insulative body is seated in the housing passage. All of the contacts are individually resident in distinct ones of such trace openings and are electrically connected to the traces.

Various changes to the foregoing structures and modifications in the described practices may be introduced without departing from the invention. The illustrated and discussed preferred embodiments are accordingly intended in an illustrative and not in a limiting sense. The true scope of the invention is set forth in the following claims.

What is claimed is:

1. An electrical connection assembly for accommodating in electrical interconnection fashion, distinct plural electrical cable terminations, said assembly comprising;

a plurality of substantially identical electrical contacts;

an electrically conductive housing having an electrically conductive part defining at least a preselected one of said contacts; and an electrically insulative insert supported by said housing and supporting the other ones of said contacts;

said housing further including an open front face, an open rear face, plural compartments extending interiorly from said front face for receipt of said distinct plural cable terminations and a passage disposed interiorly of said rear face and being in communication with said compartment for accommodating said insert and permitting entry of said other contacts into said compartments.

2. The invention claimed in claim 1 wherein said insert supports such other contacts in rectilinear array and wherein said housing supports such preselected contact in alignment with such other contacts.

3. The invention claimed in claim 2 wherein uniform rectilinear spacing exists as among all said contacts.

4. The invention claimed in claim 3 wherein said housing includes a member in electrically continuous relation with said preselected contact and adapted for electrically connecting said housing with parent structure separate therefrom.

5. The invention claimed in claim 1 wherein said insert includes projections for respective disposition in such passages, said contacts extending outwardly of said projections into said compartments.

6. The invention claimed in claim 5 wherein said insert further includes an opening extending therethrough, said preselected contact being resident in and extending outwardly of said opening.

7. The invention claimed in claim 6 wherein said insert further includes spacing projections extending outwardly thereof to a lesser extent than such outward extent of said preselected contact.

* * * * *